US006638146B2

(12) United States Patent
Naruo

(10) Patent No.: US 6,638,146 B2
(45) Date of Patent: Oct. 28, 2003

(54) RETENTION PLATE FOR POLISHING SEMICONDUCTOR SUBSTRATE

(75) Inventor: Naoya Naruo, Imari (JP)

(73) Assignee: Sumitomo Mitsubishi Silicon Corporation, Tokyo (JP)

( * ) Notice: Subject to any disclaimer, the term of this patent is extended or adjusted under 35 U.S.C. 154(b) by 0 days.

(21) Appl. No.: 10/022,415

(22) Filed: Dec. 20, 2001

(65) Prior Publication Data

US 2002/0098786 A1 Jul. 25, 2002

(30) Foreign Application Priority Data

Jan. 24, 2001 (JP) ..... 2001-015561

(51) Int. Cl.[7] ..... B24B 1/00

(52) U.S. Cl. ..... 451/41; 451/287; 451/288; 451/289; 451/364; 451/388; 451/397; 451/398

(58) Field of Search ..... 451/41, 287, 288, 451/289, 364, 388, 397, 398

(56) References Cited

U.S. PATENT DOCUMENTS 5,882,243 A * 3/1999 Das et al. ..... 451/5

6,431,968 B1 * 8/2002 Chen et al. ..... 451/398

FOREIGN PATENT DOCUMENTS

| | | |
|---|---|---|
| JP | 2538511 | 4/1995 |
| JP | 10-109241 | 4/1998 |

* cited by examiner

*Primary Examiner*—Joseph J. Hail, III
*Assistant Examiner*—Shantese McDonald
(74) *Attorney, Agent, or Firm*—Breiner & Breiner, L.L.C.

(57) ABSTRACT

The present invention has an object to provide a retention plate used in a polishing device that mirror polishes semiconductor substrates such as silicon wafers, particularly a retention plate used with the hard chuck method, that can prevent roll-off, and can achieve a high improvement in flatness. According to the present invention, by means of using a retention plate of a constitution that is of a smaller diameter than that of the wafer and which gives a region in which the area of contact with the wafer is reduced by means of groove processing, or a porous structure and the like, on the outer peripheral part, a reduction of the processing pressure of the outer peripheral part becomes possible, and, because the polishing of the region in which roll-off occurs is delayed, the amount removed by polishing becomes uniform over the wafer surface, and high precision wafer processing becomes possible.

2 Claims, 3 Drawing Sheets

RETENTION PLATE FOR POLISHING SEMICONDUCTOR SUBSTRATE

BACKGROUND OF THE INVENTION

1. Field of the Invention

The present invention relates to an improvement of the retention plate used in a polishing device that mirror polishes semiconductor substrates such as silicon wafers. Particularly, by using an adhesive or vacuum adhesion and making the outer diameter of the retention plate that holds the wafer smaller than the diameter of the substrate subject to polishing, and causing the area of contact with the substrate to be reduced from the inner peripheral part side only on the outer peripheral part with a specific width, the present invention is able to reduce the polishing pressure of the outer peripheral part side, improve the polishing precision of the semiconductor substrate by delaying the polishing, eliminate the so-called roll-off of the substrate, and obtain a wafer with an extremely high flatness.

2. Description of the Related Art

At the time of manufacturing semiconductor substrates such as silicon wafers and the like, a surface treatment process such as lapping or polishing is indispensable for shaving the surface fracture layer generated at the time of slicing and obtaining a flawless single crystal face.

When grinding and polishing the substrate during the surface treatment process, in order to fix a wafer and the like to a grinding/polishing device, with the polishing device shown in FIG. 1, for example, the semiconductor substrate or wafer 3 is caused to contact the surface of the retention plate 2 held by the rotating carrier 1 and fastened using an adhesive or vacuum adhesion, the wafer 3 surface subject to polishing is caused to contact the polishing cloth 4 provided on the top surface of the polishing table 5, and the rotating carrier 1 is pressurized and rotated in order to conduct polishing.

As methods of retaining substrates subject to polishing, mainly, a method for attaching a wafer with wax to a hard ceramic or a resin board of acrylic, polycarbonate and the like for polishing bare wafers, or a method of retaining wafers by adsorption upon providing multiple perforations of minute holes or processing grooves on the retention plate surface (hereinafter called the hard chuck method) has been employed.

For the final polishing of bare wafers and polishing of surface oxide films after device preparation, mainly, a method of retaining the outer periphery of the wafer with a guide ring upon attaching the wafer with the surface tension of wafer on a soft backing pad surface (hereinafter called the soft chuck method) has been employed.

The demand for making recent semiconductor devices to be of a high precision and enlarging the diameter of silicon wafers is increasing, and polishing precision, particularly, the improvement of flatness, has been in great demand.

In the mirror polishing process that determines the final flatness of a wafer, as mirror polishing is performed upon eliminating processing distortion, materials such as urethane foam and polyester nonwoven fabric that are softer than the wafer are generally used as the polishing cloth.

When polishing is carried out with a polishing cloth made of material softer than the wafer, the polishing cloth 4 during processing becomes deformed at the outer periphery of the wafer 3, as shown in the polishing model of FIG. 2, because pressure is applied from the wafer. When polishing is carried out in this state, the outer peripheral part of the wafer 3 becomes actively processed, and the flatness of the wafer 3 after polishing deteriorates considerably at the outer peripheral part. In the drawing, the fine broken line 6 indicates the amount of polishing of the wafer, the thick broken line 7 indicates the polishing pressure, and the two point chain line 8 indicates the amount of deformation of the polishing cloth.

In the experimentation conducted by the inventor; that is, during the 15 minutes of polishing, it was confirmed that polishing progresses about 1 $\mu$m in a range approximately 10 mm inward from the outer peripheral edge of the wafer in comparison with the central part thereof. Although hardening the polishing cloth and reducing the amount of deformation of the polishing cloth at the wafer periphery are considered to be effective in order to prevent a polishing abnormality known as roll-off, there is a fear of the hard polishing cloth scratching the wafer surface.

In the final polishing of wafers, adopted is a method of reducing the amount of deformation of the polishing cloth in the wafer region by establishing a retainer ring at the outer peripheral part of the backing pad and pressing down the polishing cloth at the outer peripheral part of the wafer with a retainer during polishing, or a method of reducing the pressure applied to the outer peripheral part with a backing pad of a small diameter.

However, when employing a retention plate with a small diameter, the outer peripheral part of the backing pad deforms during pressurization when a soft backing pad is used, and absorbs the difference in the processing pressure at the outer peripheral part of the wafer. Meanwhile, since the retention plate does not deform in the hard chuck method, it is difficult to acquire the effect of reducing the processing pressure at the outer peripheral part even if the diameter is made small.

Furthermore, when the diameter of the retention plate is sufficiently reduced, the pressure difference of the outer peripheral part of the retention plate applied to the wafer is directly communicated to the wafer, and depressions are formed in the parts where the pressure rapidly changes after polishing, thereby deteriorating the precision after polishing even if the roll-off is improved. Thus, a retention plate with a diameter smaller than the wafer could not be used in the hard chuck method.

SUMMARY OF THE INVENTION

The present invention has an object to provide a retention plate used in a polishing device that mirror polishes semiconductor substrates such as silicon wafers, wherein the demand for making semiconductor devices to be of a high precision and enlarging the diameter of silicon wafers is increasing, particularly a retention plate used with the hard chuck method, that can prevent roll-off, and can achieve a high improvement in flatness.

The inventor conducted various and studies aimed at the constitution of a retention plate for polishing that would not cause roll-off in the outer peripheral part of a wafer, even with a hard retention plate for polishing. That is, generally, because in wafer polishing the amount of polishing greatly depends on the polishing pressure, if the pressing force of the outer peripheral part is reduced, the above-mentioned roll-off can be reduced. Roll-off also depends on the physical properties of the polishing cloth used, but, generally, in the case of a 200 mm diameter wafer, sagging occurs in a region 10 mm from the outer periphery of the wafer, and becomes exponentially stronger towards the outer periphery of a wafer.

In causing a change of pressure so as to run counter to this roll-off shape, polishing may be carried out without holding the outer peripheral part of a wafer. Nevertheless, as mentioned above, with a hard polishing retention plate, even if the diameter of the retention plate is made smaller than that of the wafer, because the retention plate itself does not deform due to the pressing force from the wafer as with the soft backing pad, such effect is difficult to obtain. Furthermore, the fluctuations of the pressing force at the held parts and the parts that are not held become too large, and, on the contrary, the wafer shape after polishing may become worse.

Accordingly, as a result of further diligent studies concerning a retention plate for polishing that can prevent the roll-off of a wafer, it became known that, by means of using a retention plate of a constitution that gives a region in which the area of contact with the wafer is reduced due to groove processing, or a porous structure and the like, on the outer peripheral part with a diameter smaller than the wafer, a reduction of the processing pressure on the outer peripheral part becomes possible, and, because the polishing of the region where roll-off occurs is delayed, the amount removed by polishing becomes uniform within the wafer surface and processing of high precision wafer becomes possible, and this invention was thus perfected.

In other words, with respect to a retention plate for polishing which holds a semiconductor substrate on a rotating carrier for polishing use, the present invention is a retention plate used for the polishing of a semiconductor substrate in which the diameter of the retention plate is smaller than the diameter of the substrate subject to polishing, and having a means for reducing the area that contacts the substrate at the outer peripheral part thereof compared with the inner peripheral part of the retention plate.

With respect to a semiconductor wafer grinding and polishing device, the present invention makes the diameter of the wafer retention plate smaller than that of the wafer subject to processing, and, by providing a region that has caused a reduction of the area of contact with the wafer, by means of groove processing or a porous structure at the outer peripheral part of the retention plate, polishing pressure of the outer peripheral part is reduced, deformation of the polishing cloth of the outer peripheral part of the wafer during polishing is reduced, roll-off that occurs by means of this is prevented, and an extremely flat semiconductor wafer is obtained thereby.

DESCRIPTION OF THE PREFERRED EMBODIMENTS

The present invention, in a hard retention plate, makes the retention plate of a smaller diameter than that of the wafer and provides a region that causes a decrease of the area of contact with the wafer on the outer peripheral part of the retention plate, thereby decreasing the processing pressure of the outer peripheral part of the wafer, deterring roll-off and enabling wafer polishing of a high flatness.

Figure 1:
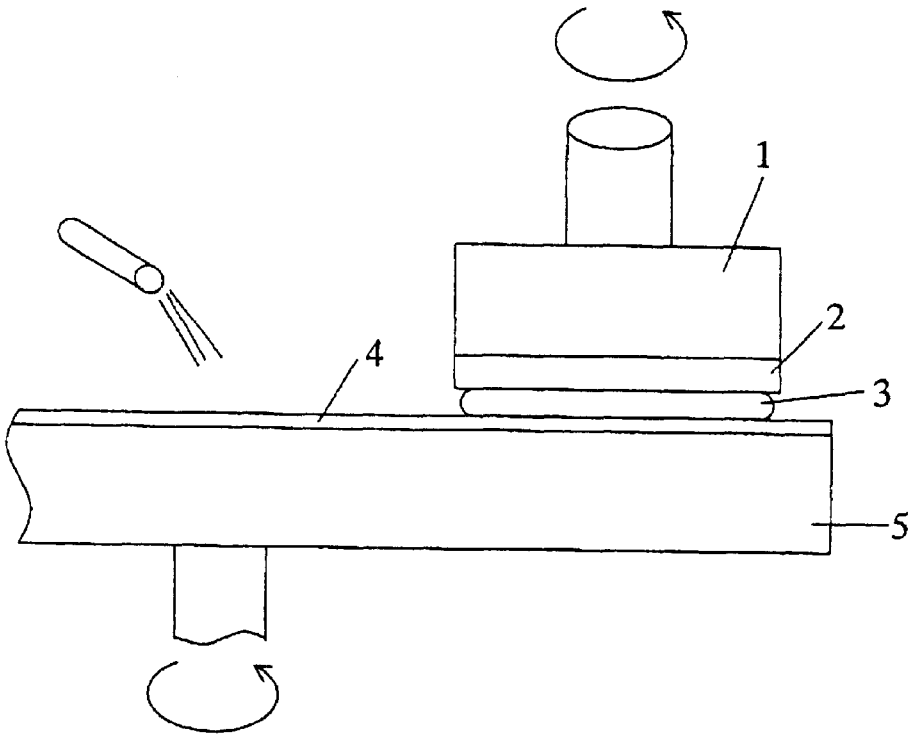
FIG. 1 is an explanatory figure that shows one example of a silicon wafer polishing device.
Figure 2:
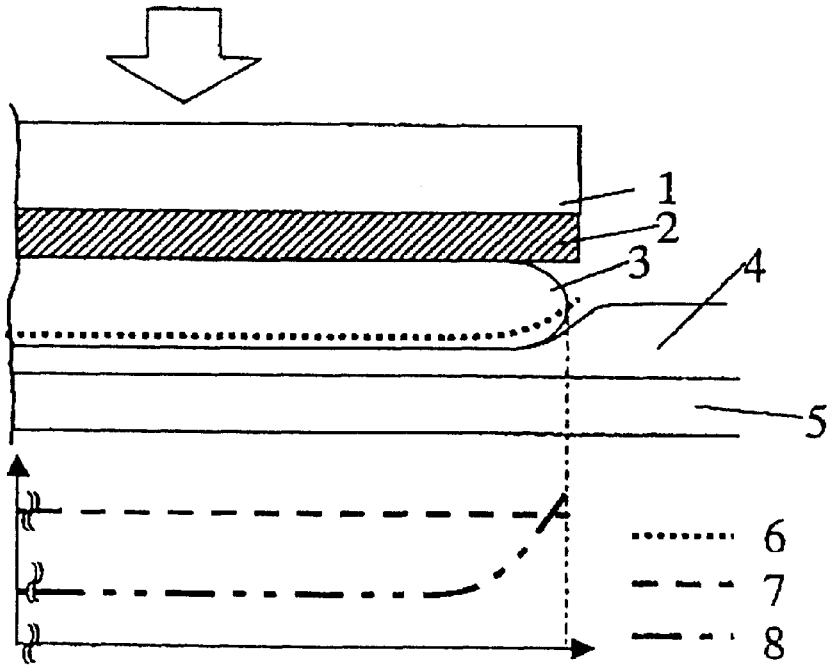
FIG. 2 is an explanatory figure that shows a polishing model in the case of the conventional example in which the diameter of the retention plate is larger than the diameter of the wafer subject to polishing, in the device depicted in FIG. 1.
Figure 3:
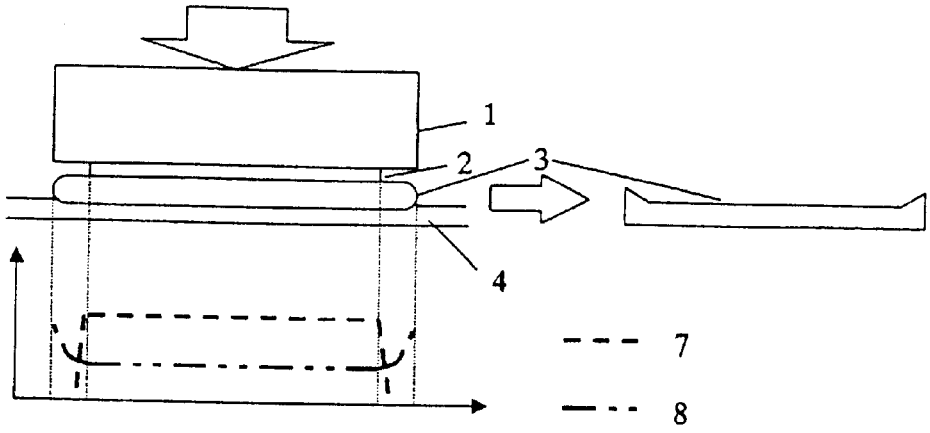
FIG. 3 is an explanatory figure that shows a polishing model in the case of a comparative example in which the diameter of the retention plate is less than the diameter of the wafer subject to polishing, in the device depicted in FIG. 1.

Normally, in the case in which a hard retention plate is made of a small diameter, as shown in FIG. 3, because the rigidity of the retention plate 2 is high, the polishing pressure 7 at the outer peripheral part of the wafer 3 suddenly fluctuates, and, even if roll-off can be deterred, a harmful influence is exerted on the flatness of the wafer.

Figure 4:
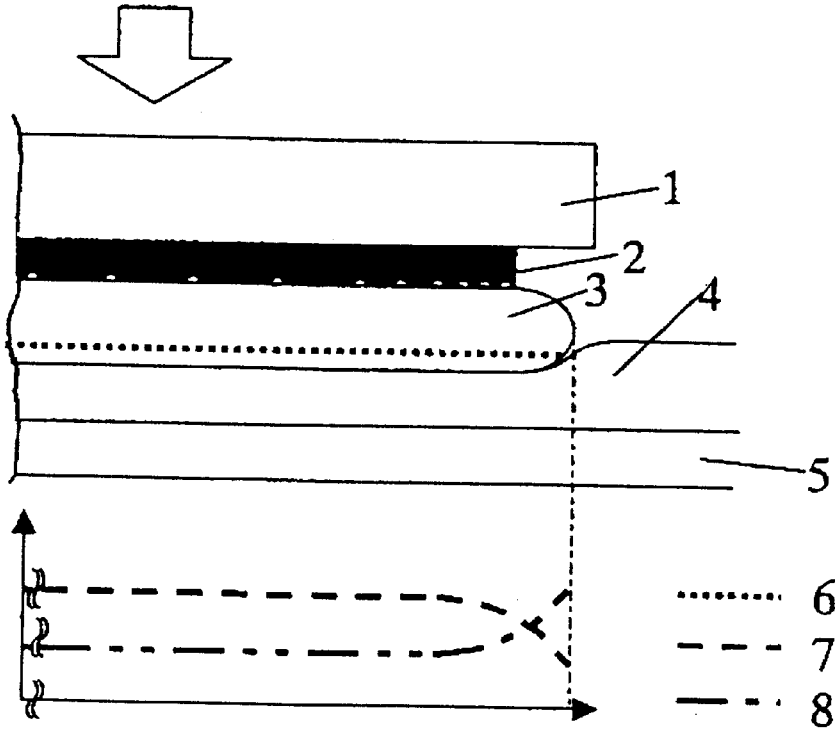
FIG. 4 is an explanatory figure that shows a polishing model in the case of the present invention in which the diameter of the retention plate is less than the diameter of the wafer subject to polishing, in the device depicted in FIG. 1.

Accordingly, as for the retention plate 2 of the present invention, because the polishing pressure 7 is made so as to be modeled on the amount of deformation 8 of the polishing cloth 4, when groove processing is performed on the outer peripheral part of the retention plate 2 and a region that causes a decrease in the area that contacts the wafer is provided, as shown in FIG. 4, and the relationship of the amount of deformation 8 of the polishing cloth and the polishing pressure 7, as illustrated, becomes a relative relationship at the outer peripheral part of the wafer 3, the amount of polishing within the wafer 3 surface becomes uniform, and a wafer of a high flatness can be obtained thereby.

In the present invention it is desirable that the diameter of the retention plate be 90% or more, and less than 100%, of the diameter of the substrate subject to polishing. That is, when the diameter of the retention plate exceeds 100% of the diameter of the substrate subject to polishing, there is no effect that decreases the roll-off, and when it is less than 90%, on the contrary, the shape attribute, that the outer peripheral part of the wafer rises, worsens.

In the present invention it is desirable that the rate of decrease of the contact area of the outer peripheral part of the retention plate be 1% or more, and 10% or less by area ratio compared with the inner peripheral part. At less than 1% by the above-mentioned area ratio there is no effect that deters roll-off, and when 16% is exceeded, on the contrary, the shape attribute, that the outer peripheral part of the wafer rises, worsens. Still more preferable is a range of 4% to 13%.

In the present invention, groove processing, a porous structure and the like can be adopted as a means to reduce the contact area. As retention plate material, any material such as ceramics, acrylic, metal and the like can be adopted, for example, as for adhesion use, when composed of porous ceramics, creating a plurality of minute grooves with depth dimensions of 0.5 mm or more and width dimensions of 0.5 mm to 1.0 mm on the substrate adhesion side, and arranging minute grooves in concentric circles is desirable.

Furthermore, it is desirable that the average pore diameter of the porous ceramics exceeds 10 $\mu$m and be 50 $\mu$m or less, that the porosity is 30% to 50%, that the average pore diameter of the porous ceramics in a range of 3 mm to 10 mm from the outer peripheral edge amounts to 10 $\mu$m or less, and that the average pore diameter of the porous ceramics other than this is made 20 $\mu$m to 50 $\mu$m.

EMBODIMENTS

Embodiment 1

Using a retention plate with a diameter of 195 mm and a material composed of acrylic resin, five types of retention plates were prepared, by means of groove processing a region of 10 mm of the outer peripheral part thereof, that caused reductions of the contact area by 1%, 5%, 10%, 15% and 20%, respectively.

Using retention plates of the above-mentioned five types, a polishing pressure of 50 kg was applied to a silicon wafer with a diameter of 200 mm and polishing was carried out to remove 10 $\mu$m of the surface. After polishing, the flatness of the outer peripheral part of the silicon wafer was measured.

Figure 5:
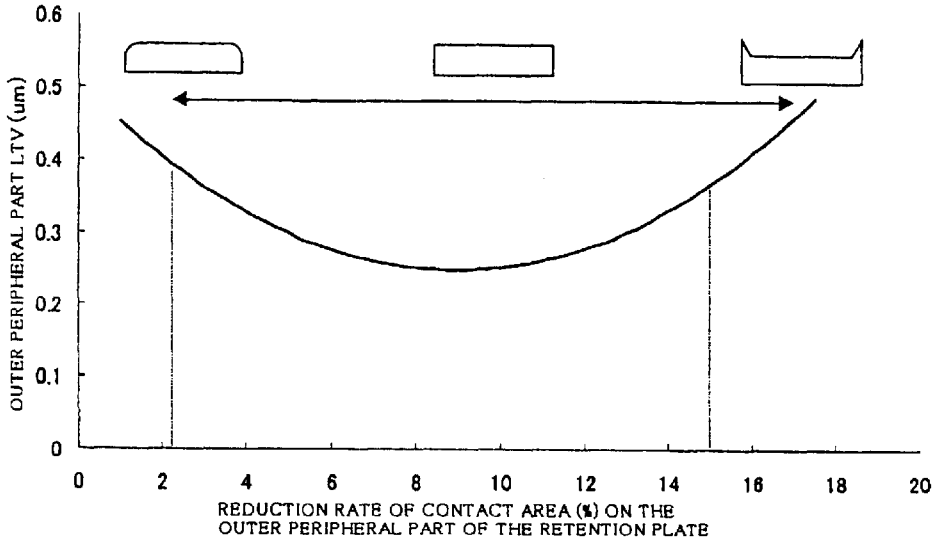
FIG. 5 is a graph that shows the relationship between the reduction rate of the contact area and the LTV of the outer peripheral part of a wafer.

The measurement result shown in the graph of FIG. 5 shows the relationship between the reduction rate of the contact surface and the LTV of the outer peripheral part of the wafer. As is clear from the graph, it was seen that, when the contact area of the outer peripheral part is caused to decrease 2% to 15%, compared with the inner peripheral part, superior polishing can be realized.

Embodiment 2

Using retention plates with diameters of 175 mm, 185 mm, 195 types of retention plates were prepared, by groove processing a region of 10 mm of the outer peripheral parts thereof, that caused a 5% reduction of the contact area.

Using retention plates of the above-mentioned five types, 50 kg of polishing pressure was applied to a silicon wafer with a diameter of 200 mm and polishing was carried out to remove 10 $\mu$m of the surface. After polishing, the flatness of the outer peripheral part of the silicon wafer was measured.

Figure 6:
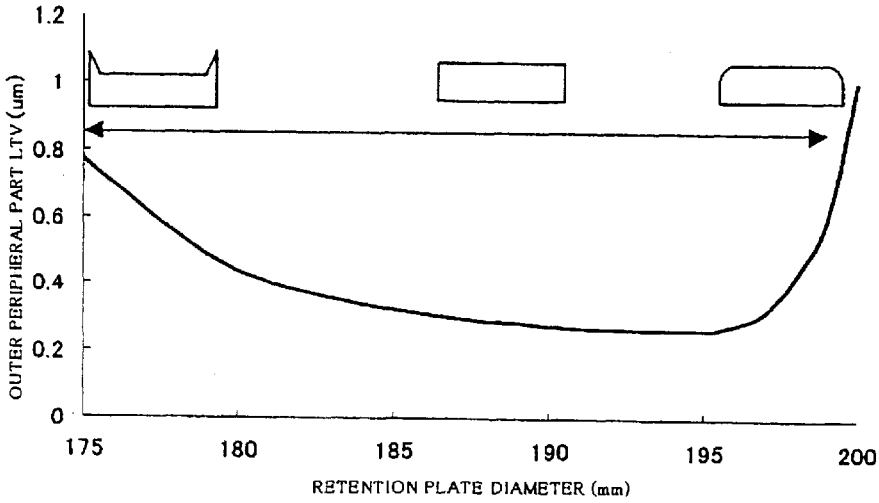
FIG. 6 is a graph that shows the relationship between the diameter of the retention plate and the LTV of the outer peripheral part of a wafer.

The measurement result shown in the graph of FIG. 6 shows the relationship between the retention plate diameter and the LTV of the outer peripheral part of the wafer. As is clear from the graph, concerning an item the same as the wafer, TTV with the roll-off amounted to 1.5 $\mu$m. Furthermore, it was seen that when the diameter of the retention plate becomes 180 mm or less, the outer peripheral part after polishing rose and the precision worsened.

What is claimed is:

1. A retention plate for polishing a semiconductor substrate while holding the semiconductor substrate in a rotating carrier comprising a retention elate having a diameter smaller than a diameter of the semiconductor substrate subject to polishing, and an outer peripheral part including means for reducing an area of contact with the semiconductor substrate as compared to an area of contact of an inner part of the retention plate, wherein the means for reducing the area of contacts is grooves in said outer peripheral part.

2. A retention elate for polishing a semiconductor substrate while holding the semiconductor substrate in a rotating carrier comprising a retention elate having a diameter smaller than a diameter of the semiconductor substrate subject to polishing, and an outer peripheral part including means for reducing an area of contact with the semiconductor substrate as compared to an area of contact of an inner part of the retention plate, wherein the means for reducing the area of contact is a porous structure in the outer peripheral part.

* * * * *

UNITED STATES PATENT AND TRADEMARK OFFICE

CERTIFICATE OF CORRECTION

PATENT NO. : 6,638,146 B1
DATED : October 28, 2003
INVENTOR(S) : Naoya Naruo

It is certified that error appears in the above-identified patent and that said Letters Patent is hereby corrected as shown below:

Column 5,
Line 23, after "195" insert -- mm, 198 mm and 200 mm and with a material composed of acrylic resin, five --.

Column 6,
Lines 19 and 21, "elate" should read -- plate --.

Signed and Sealed this

Sixth Day of April, 2004

JON W. DUDAS
*Acting Director of the United States Patent and Trademark Office*